US010088232B2

(12) United States Patent
Prajescu

(10) Patent No.: US 10,088,232 B2
(45) Date of Patent: Oct. 2, 2018

(54) DRYER APPLIANCES AND METHODS FOR OPERATING SAME

(71) Applicant: General Electric Company, Schenectady, NY (US)

(72) Inventor: Ionelia Silvia Prajescu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 643 days.

(21) Appl. No.: 14/484,711

(22) Filed: Sep. 12, 2014

(65) Prior Publication Data

US 2016/0076814 A1 Mar. 17, 2016

(51) Int. Cl.
*D06F 58/28* (2006.01)
*F26B 21/06* (2006.01)

(52) U.S. Cl.
CPC ..... *F26B 21/06* (2013.01); *D06F 58/28* (2013.01); *D06F 2058/2861* (2013.01); *D06F 2058/2864* (2013.01); *D06F 2058/2896* (2013.01)

(58) Field of Classification Search
CPC .. F26B 21/06; D06F 58/28; D06F 2058/2896; D06F 2058/2864; D06F 2058/2861
See application file for complete search history.

(56) References Cited

U.S. PATENT DOCUMENTS

| | | | | |
|---|---|---|---|---|
| 6,819,255 | B2 | 11/2004 | Chernetski | |
| 7,013,578 | B2 | 3/2006 | Wunderlin et al. | |
| 7,322,126 | B2 | 1/2008 | Beaulac | |
| 7,478,486 | B2 * | 1/2009 | Wunderlin | D06F 58/28 34/261 |
| 7,941,937 | B2 | 5/2011 | Do | |
| 8,196,313 | B2 | 6/2012 | Han | |
| 8,555,522 | B2 | 10/2013 | Bellinger et al. | |
| 8,701,309 | B2 | 4/2014 | Park et al. | |
| 2006/0191161 | A1 | 8/2006 | Wunderlin et al. | |
| 2009/0090020 | A1 | 4/2009 | Choi et al. | |
| 2012/0022830 | A1 * | 1/2012 | Prajescu | D06F 58/28 702/176 |
| 2012/0096738 | A1 * | 4/2012 | Bellinger | D06F 58/28 34/493 |
| 2013/0326904 | A1 | 12/2013 | Altinier et al. | |

* cited by examiner

*Primary Examiner* — Jessica Yuen
(74) *Attorney, Agent, or Firm* — Dority & Manning, P.A.

(57) ABSTRACT

Dryer appliances and methods for operating dryer appliances are provided. A method includes calculating an initial cycle time, and counting down from the initial cycle time for an initial countdown time. The method further includes determining, during the step of counting down from the initial cycle time for the initial countdown time, whether a load size value and an air flow value have been established. The method further includes calculating, when the load size value and the air flow value have been established, a first updated remaining cycle time based on the load size value and the air flow value.

15 Claims, 4 Drawing Sheets

DRYER APPLIANCES AND METHODS FOR OPERATING SAME

FIELD OF THE INVENTION

The present subject matter relates generally to dryer appliances and associated methods for operating dryer appliances.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, a blower is utilized to flow the internal air from the vent duct to the exhaust duct. When operating the blower may pull air through itself from the vent duct, and this air may then flow from the blower to the exhaust conduit.

One issue that exists with dryer appliances is the predictability of the drying time for a load of articles being dried. It is generally understood that drying time is a function of, for example, the desired cycle, the desired amount of heat, and the desired dryness. One presently known solution for predicting drying time based on such variables during operation of a dryer appliance is provided in U.S. Patent Application Publication No. 2006/0191161, filed on Jan. 20, 2006 and published on Aug. 31, 2006, which is incorporated by reference herein in its entirety.

Nevertheless, issues remain with accurately predicting drying time. In some cases, a drying cycle may conclude earlier than the predicted drying time that was initially or subsequently displayed during operation of the dryer appliance. In these cases, articles can be left in the dryer appliance to wrinkle for substantial periods of time. In other cases, a drying cycle may continue past the predicted drying time. The display of predicted drying time can revert to "racetrack" mode, outputting a rotating display of light indicators, or another indicator output to indicate that the predicted drying time is being adjusted. This can be frustrating to a user to expects to see a relatively accurate drying time display.

Accordingly, improved dryer appliances and methods for operating dryer appliances are desired. In particular, dryer appliances and methods that provide improved drying time prediction accuracy would be advantageous.

BRIEF DESCRIPTION OF THE INVENTION

In one embodiment, a method for operating a dryer appliance is provided. The method includes calculating an initial cycle time, and counting down from the initial cycle time for an initial countdown time. The method further includes determining, during the step of counting down from the initial cycle time for the initial countdown time, whether a load size value and an air flow value have been established. The method further includes calculating, when the load size value and the air flow value have been established, a first updated remaining cycle time based on the load size value and the air flow value.

In another embodiment, a dryer appliance is provided. The dryer appliance includes a cabinet defining an interior, and a drum positioned within the interior, the drum defining a chamber for receipt of articles for drying. The dryer appliance further includes a heating assembly, an inlet duct providing fluid communication between the drum and the heating assembly, and an outlet assembly, the outlet assembly comprising a vent duct and an exhaust conduit. The dryer appliance further includes a controller. The controller is operable for calculating an initial cycle time, and counting down from the initial cycle time for an initial countdown time. The controller is further operable for determining, during the step of counting down from the initial cycle time for the initial countdown time, whether a load size value and an air flow value have been established. The controller is further operable for calculating, when the load size value and the air flow value have been established, a first updated remaining cycle time based on the load size value and the air flow value.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
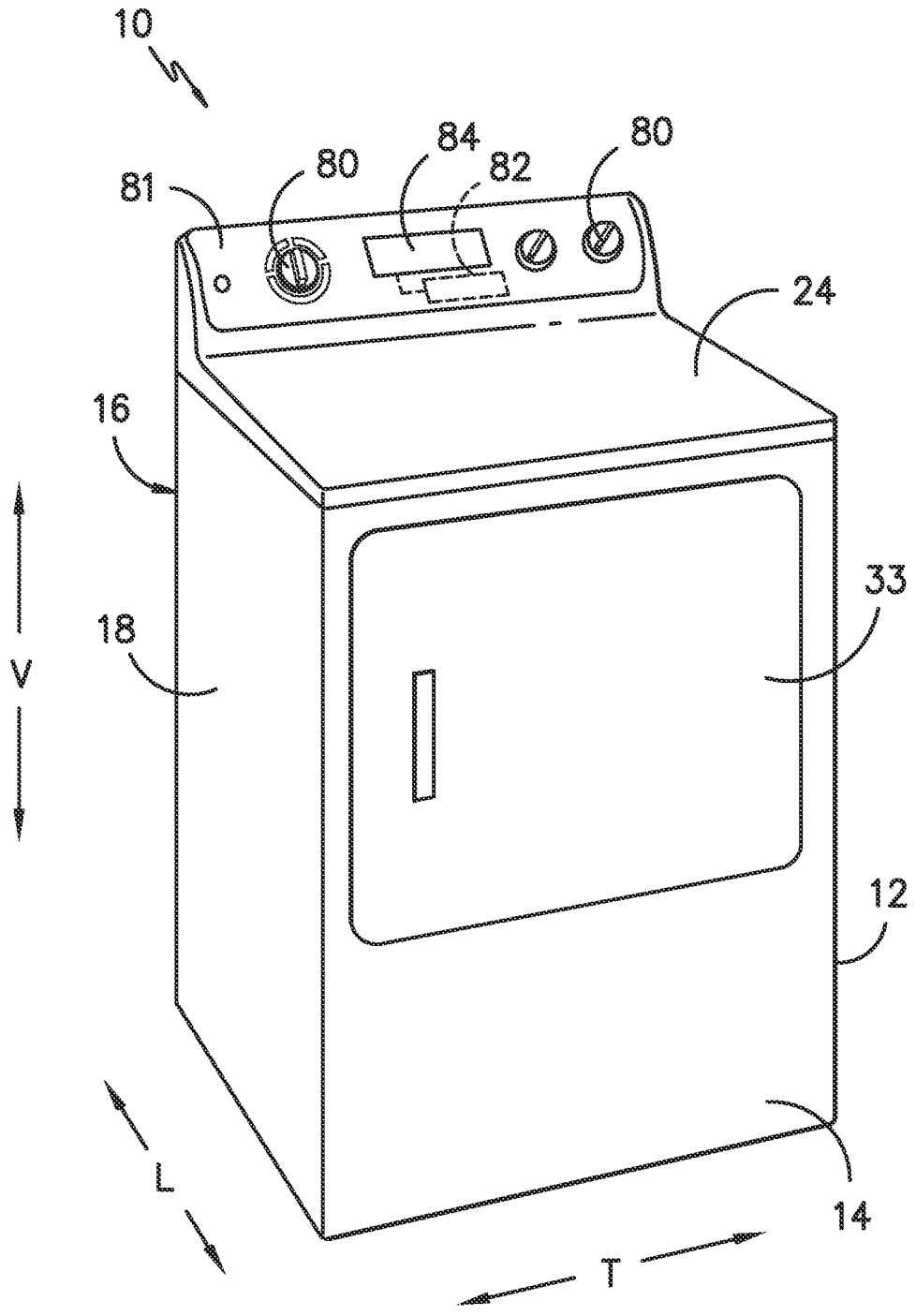
FIG. 1 provides a perspective view of a dryer appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
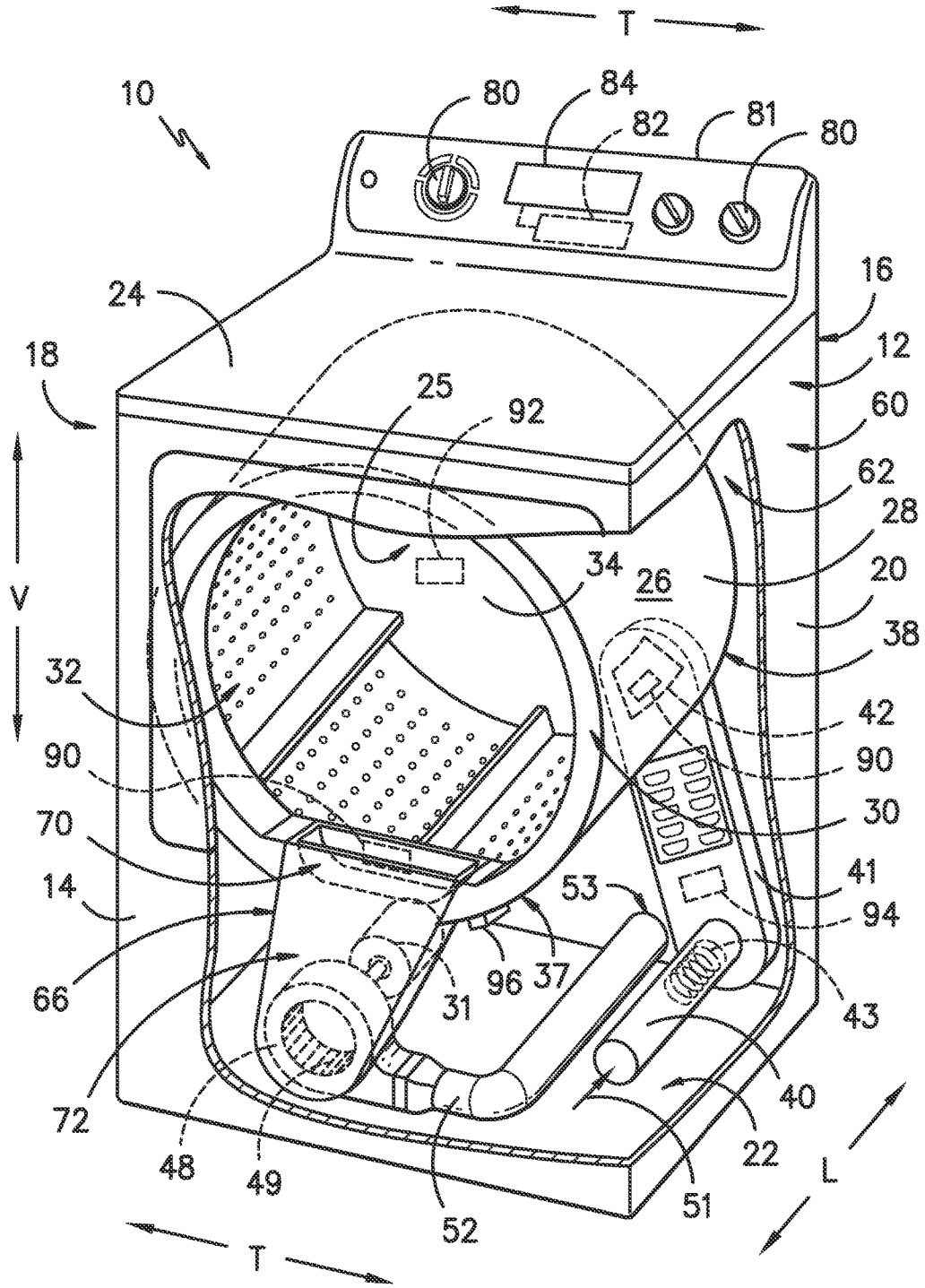
FIG. 2 provides a perspective view of the dryer appliance of FIG. 1 with portions of a cabinet of the dryer appliance removed to reveal certain components of the dryer appliance.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of the cabinet 12 and an interior 62 of the cabinet. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the lateral direction L. In exemplary embodiments the drum 26 is rotational. Alternatively, however, the drum 26 may be fixedly mounted within the interior 62.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. In alternative embodiments, entry 32 may be defined in top cover 24 and cylinder 28, and front wall 30 may be a generally solid wall.

A motor 31 may be in mechanical communication with a blower 48 such that motor 31 rotates a blower fan 49, e.g., of the blower 48. Blower 48 is configured for drawing air through chamber 25 of drum 26, e.g., in order to dry articles located therein as discussed in greater detail below. In alternative exemplary embodiments, dryer appliance 10 may include an additional motor (not shown) for rotating fan 49 of blower 48 independently of drum 26.

Drum 26 may be configured to receive heated air that has been heated by a heating assembly 40, e.g., in order to dry damp articles disposed within chamber 25 of drum 26. Heating assembly 40 includes a heater 43, such as a gas burner or an electrical resistance heating element, for heating air. As discussed above, during operation of dryer appliance 10, motor 31 rotates fan 49 of blower 48 such that blower 48 draws air through chamber 25 of drum 26. In particular, ambient air enters heating assembly 40 via an entrance 51 due to blower 48 urging such ambient air into entrance 51. Such ambient air is heated within heating assembly 40 and exits heating assembly 40 as heated air. Blower 48 draws such heated air through inlet duct 41 to drum 26. The heated air enters drum 26 through an outlet 42 of duct 41 positioned at rear wall 34 of drum 26.

Within chamber 25, the heated air can remove moisture, e.g., from damp articles disposed within chamber 25. This internal air in turn flows from the chamber 25 through an outlet assembly 64 positioned within the interior 62. The outlet assembly 64 includes a vent duct 66, the blower 48, and an exhaust conduit 52. The exhaust conduit 52 is in fluid communication with the vent duct 66 via the blower 48. During a dry cycle, internal air flows from the chamber 25 through the vent duct 66 to the blower 48 and through the blower 48 to the exhaust conduit 52, and is exhausted from the exhaust conduit 52.

In exemplary embodiments, vent duct 66 can include a filter portion 70 and an exhaust portion 72. The exhaust portion 72 may be positioned downstream of the filter portion 70 (in the direction of flow of the internal air). A screen filter of filter portion 70 (which may be removable) traps lint and other particulates as the internal air flows therethrough. The internal air may then flow through the exhaust portion 72 and the blower 48 to the exhaust conduit 52.

After the clothing articles have been dried, they are removed from the drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate motor 31 and heating assembly 40, including heater 43, in response to the position of selector inputs 80. Additionally, a display 84, such as an indicator light or a screen, may be provided on cabinet backsplash 82. The display 84 may be in communication with the controller 82, and may display information in response to signals from the controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

In some embodiments, dryer appliance 10 may additionally include one or more sensors. For example, dryer appliance 10 may include one or more temperature sensors 90. A temperature sensor 90 may be operable to measure internal temperatures in the dryer appliance 10. In some embodiments, for example, a temperature sensor 90 may be disposed in the inlet duct 41, such as at outlet 42 of the inlet duct 41, which corresponds to the inlet to drum 26. Additionally or alternatively, for example, a temperature sensor 90 may be disposed in the drum 26, such as in the chamber 25 thereof, at an outlet of the drum 26 such as in vent duct 66, or in any other suitable location within the dryer appliance 10. Temperature sensors 90 may be in communication with the controller 82, and may transmit readings to the controller 82 as required or desired.

Dryer appliance 10 may further include, for example, a dampness sensor 92. The dampness sensor 92 may be operable to measure the dampness of articles within the chamber 25 during operation of the dryer appliance 10. In particular, the dampness sensor 92 may measure voltages associated with dampness, as is generally understood. In exemplary embodiments, dampness sensor 92 may be a moisture sensor. The dampness sensor 92 may be disposed on rear wall 34 or at any other suitable location within the dryer appliance 10. Dampness sensor 92 may be in communication with the controller 82, and may transmit readings to the controller 82 as required or desired.

Dryer appliance 10 may further include, for example, an air flow sensor 94. The air flow sensor 94 may be operable to measure air flow through the dryer appliance 10 during operation of the dryer appliance 10. The air flow sensor 94 may be disposed within the inlet duct 41, exhaust conduit 52, or at any other suitable location within the dryer appliance 10. Air flow sensor 94 may be in communication with the controller 82, and may transmit readings to the controller 82 as required or desired. Notably, in alternative embodiments, air flow may be calculated without the use of an air flow sensor 94, such as though use of a suitable algorithm as is generally understood in the art. Such algorithm may in some embodiments utilize temperatures measured by temperature sensor(s) 90. Examples of suitable algorithms are provided in, for example, U.S. Pat. No. 7,322,126, filed on Apr. 27, 2006 and issued on Jan. 29, 2008, which is incorporated by reference herein in its entirety.

Dryer appliance 10 may further include, for example, a weight sensor 96. The weight sensor 96 may be operable to measure the weight of a load of articles during operation of the dryer appliance 10. The weight sensor 96 may be disposed on outer wall 28, or at any other suitable location within the dryer appliance 10. Weight sensor 96 may be in communication with the controller 82, and may transmit readings to the controller 82 as required or desired. Notably, in alternative embodiments, weight may be calculated without the use of a weight sensor, such as though use of a suitable algorithm as is generally understood in the art. Such algorithm may in some embodiments utilize temperatures measured by temperature sensor(s) 90. Examples of suitable algorithms are provided in, for example, U.S. Pat. No. 7,322,126, filed on Apr. 27, 2006 and issued on Jan. 29, 2008, which is incorporated by reference herein in its entirety.

It should be understood that, while FIGS. 1 and 2 illustrate embodiments wherein dryer appliance 10 is a horizontal axis dryer appliance, in other embodiments dryer appliance 10 may be, for example, a vertical axis dryer appliance or another suitable dryer appliance. In a vertical axis dryer appliance 10, for example, cylinder 28 of drum 26 may extend along the vertical axis V between rear wall 34 and front wall 30. Accordingly, the present disclosure is not limited to horizontal axis dryer assemblies. Rather, any suitable dryer appliance is within the scope and spirit of the present disclosure.

Figure 3:
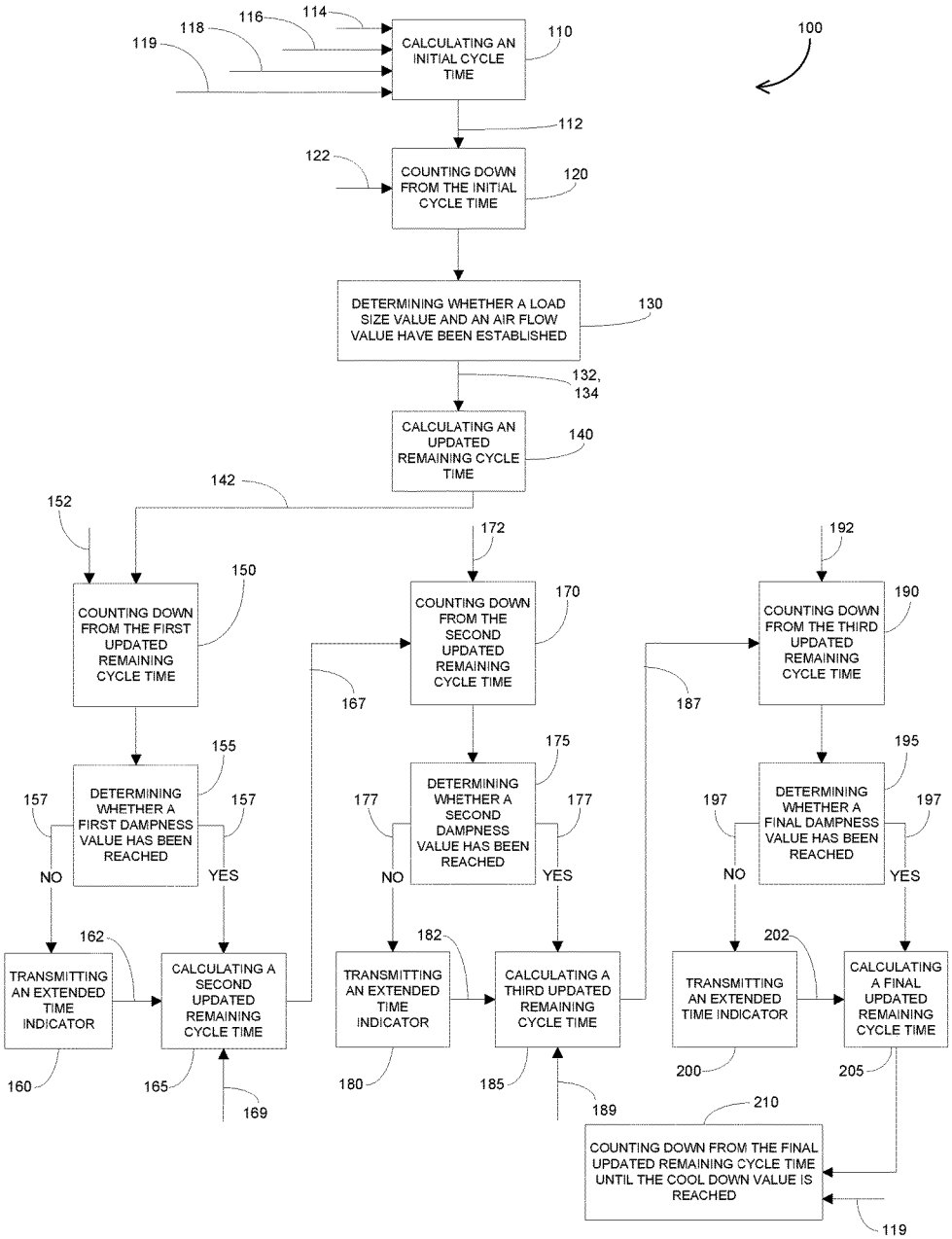
FIG. 3 is a flow chart illustrating method steps in accordance with one embodiment of the present disclosure.
Figure 4:
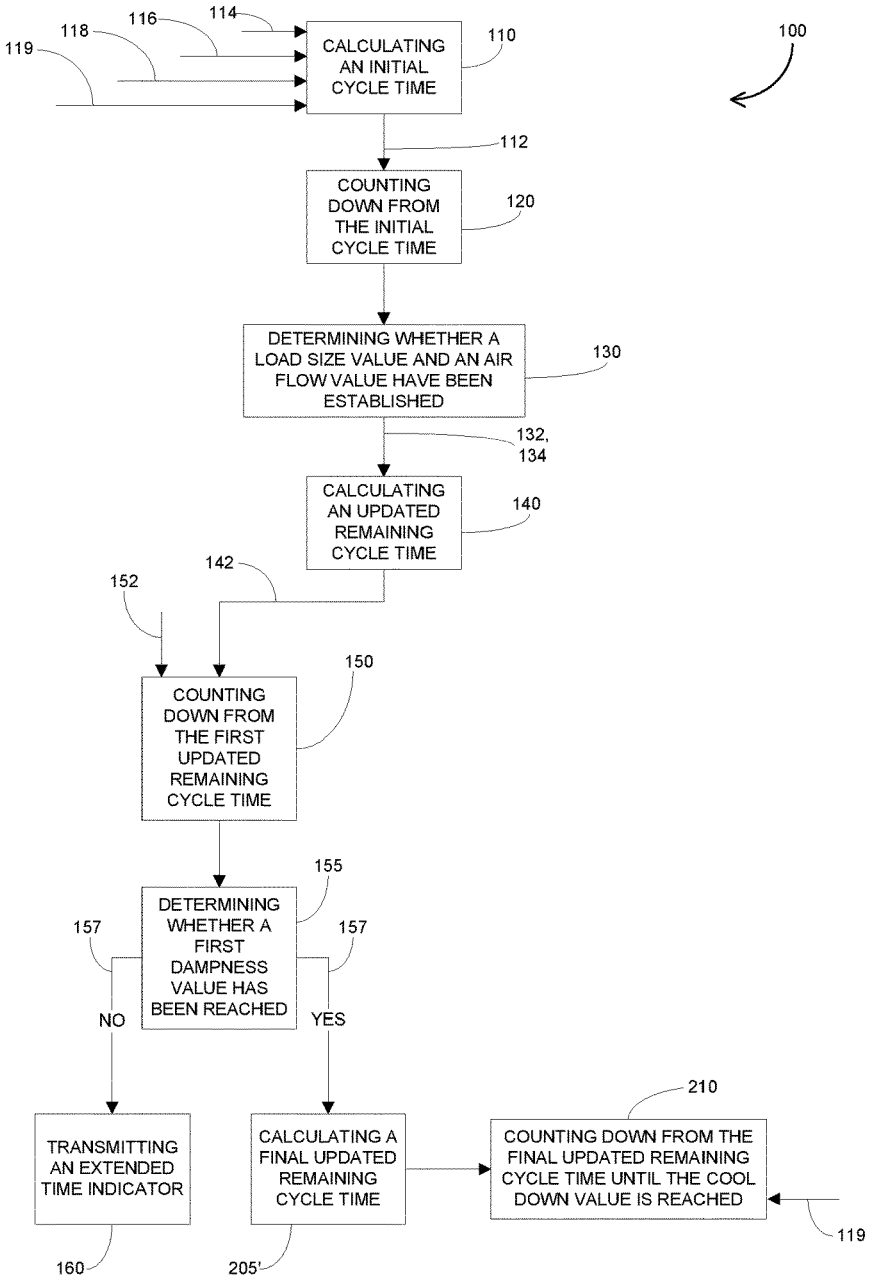
FIG. 4 is a flow chart illustrating method steps in accordance with another embodiment of the present disclosure.

Referring now to FIGS. 3 and 4, the present disclosure is further directed to methods for operating dryer appliances, as denoted generally by reference numeral 100. Methods in accordance with the present disclosure may advantageously provide improved accuracy in the prediction of the cycle time for the dryer appliance 10, through advantageous use of various values associated with the load of articles being dried and advantageous updating of the cycle time prediction during operation. In particular, use of the load size and the air flow during operation of the dryer appliance 10 facilitate more accurate cycle time prediction. Further, updating of the predicted cycle time at various dampness thresholds for the load of articles may further facilitate more accurate cycle time prediction.

Advantageously, in exemplary embodiments, the various method steps discussed herein may be performed by controller 82, which may for example be in communication with sensors 90, 92, 94, 96, algorithms and/or other various components such as selector inputs 80 as discussed herein.

Method 100 may include, for example, the step 110 of calculating an initial cycle time 112. The initial cycle time 112 calculation may, for example, be based on various inputs provided by a user through use of the selector inputs 80, including for example a cycle value 114, a heat value 116, and a dryness value 118. Cycle value 114 may be based on the cycle selected by a user, such as a normal cycle, cottons, delicate, mixed load, towels, etc. Each cycle may be assigned a value, which may be determined through experimental iteration and programmed into the controller 82. Heat value 116 may be based on a desired amount of heat selected by a user, such as high heat, normal heat, low heat, etc. Each cycle may be assigned a value, which may be determined through experimental iteration and programmed into the controller 82. Dryness value 118 may be based on a desired dryness selected by a user, such as normal dry, extra dry, damp, slightly damp, etc. Each cycle may be assigned a value, which may be determined through experimental iteration and programmed into the controller 82. Initial cycle time 112 may additionally be based on other values, such as a detangle value, an efficiency value, etc., each of which may be assigned a value, which may be determined through experimental iteration and programmed into the controller 82. Additionally, initial cycle time 112 may be based on a cool down value 119, which may be determined through experimental iteration and programmed into the controller 82. Initial cycle time 112 may, for example, be calculated by multiplying cycle value 114 (which may be a base time for the selected cycle) by various other values, such as heat value 116, dryness value 118, etc. (which may be multipliers) and then adding cool down value 119 to the resulting corrected cycle value.

Method 100 may further include, for example, the step 120 of counting down from the initial cycle time 112 for an initial countdown time 122. The initial countdown time 122 may, for example, be a predetermined amount of time that may be programmed into the controller 82. In some embodiments, the time may be, for example, between approximately 2 minutes and approximately 5 minutes. In some embodiments, the initial countdown time 122 may be based on the cycle value 114 or another suitable value, and a specific time 122 may be utilized depending on the cycle or other variable chosen. In other embodiments, the initial countdown time 122 may be independent of such values and variables, and may simply be a programmed amount of time.

Method 100 may further include, for example, the step 130 of determining whether a load size value 132 and an air flow value 134 have been established. Such step 130 may occur, for example, during the step 120 of counting down from the initial cycle time 112 for the initial countdown time 122. The load size value 132 may be based on, for example, the weight of a load of articles sensed by weight sensor 96 or calculated by a suitable algorithm as discussed herein, or the size of the load as measured using another suitable measurement apparatus or method, as are generally understood in the art. In some embodiments, categories for the load size value 132 may include, for example, small, large, medium, etc. The air flow value 134 may be based on, for example, the air flow sensed by air flow sensor 94, calculated by a suitable algorithm as discussed herein, or measured using another suitable measurement apparatus or method, as is generally understood in the art. In some embodiments, categories for the air flow value 134 may include, for example, low, high, medium, etc.

In accordance with step 130, during the step 120 of counting down, it is determined whether a load size value 132 and an air flow value 134 have been established. Method 100 may further include, for example, the step 140 of calculating an updated remaining cycle time 142, such as a first updated remaining cycle time 142, based on the load size value 132 and the air flow value 134. Such step 140 may occur, for example, when the load size value 132 and the air flow value 134 have been established, such as during the initial countdown time 122. The first updated remaining cycle time 142 may in exemplary embodiments be further based on the cycle value 114, heat value 116, dryness value 118, cool down value 119, and other suitable values as discussed above in the context of step 120.

In some embodiments, each category of load size value 132 and air flow value 134 may be assigned a value, which may be determined through experimental iteration and programmed into the controller 82. In other embodiments, a value, which may be known as a correction factor, may be assigned to a set or combination of categories. For example, a value may be assigned to each combination of categories for load size value 132, air flow value 134, and cycle value 114. These values may be determined through experimental iteration and programmed into the controller 82.

Updated remaining cycle time 142 may, for example, be calculated by initially calculating an updated cycle value. The updated cycle value may be calculated by, for example, dividing the correction factor by the initial cycle time 112, and multiplying this result by the cycle value 114. After obtaining the updated cycle value, the updated remaining cycle time 142 may be determined by multiplying the updated cycle value by the various other values, such as heat value 116, dryness value 118, etc. and then adding cool down value 119 to the resulting updated corrected cycle value. Finally, the total elapsed time of the cycle may be subtracted from this value to obtain an updated remaining cycle time 142.

The calculation of updated remaining cycle time 142 in accordance with the present disclosure may advantageously improve the accuracy of the cycle time prediction, by utilizing load size values 132 and the air flow values 134 to update the cycle time prediction during operation of the appliance 10. Further, additional updating as discussed herein may further increase the cycle time prediction accuracy.

For example, method 100 may further include the step 150 of counting down from the first updated remaining cycle time 142 for a first subsequent countdown time 152. The first subsequent countdown time 152 may, for example, be a predetermined amount of time that may be programmed into the controller 82. In some embodiments, the first subsequent countdown time 152 may be based on the cycle value 114 or another suitable value, and a specific time 152 may be utilized depending on the cycle or other variable chosen. In other embodiments, the first subsequent countdown time 152 may be independent of such values and variables, and may simply be a programmed amount of time.

Method 100 may further include, for example, the step 155 of determining whether a first dampness value 157 has been reached. Such step 155 may occur, for example, during the step 150 of counting down from the first updated remaining cycle time 142 for the first subsequent countdown time 152. The first dampness value 157 may be based on, for example, the dampness sensed by the dampness sensor 92, which may for example be a voltage or other suitable variable. The first dampness value 157 may be determined through experimental iteration and programmed into the controller 82. Notably, the value 157 may further be associated with a specific category of dryness value 118, such as damp.

In some cases, the threshold of the first dampness value 157 may not be reached during first subsequent countdown time 152. Method 100 may thus further include, for example, the step 160 of transmitting an extended time indicator 162. Such step 160 may occur, for example, when the first subsequent countdown time 152 expires and, at the time of this expiration, the first dampness value 157 has not been reached. The extended time indicator 162 may, for example, be transmitted to the display 84. In some embodiments, the display 84 may indicate a "racetrack" mode when the extended time indicator 162 is transmitted thereto. The extended time indicator 162 may remain and continue to be transmitted until the first dampness value 157 is reached, at which point the method may proceed to step 165 as discussed below.

In other cases, the threshold of the first dampness value 157 may be reached during first subsequent countdown time 152. In some embodiments, as illustrated in FIG. 3, method 100 may thus further include, for example, the step 165 of calculating a second updated remaining cycle time 167 based on the load size value 132 and the air flow value 134. Such step 165 may occur when, for example, the first dampness value 157 has been reached.

For example, in some embodiments, a second value, or correction factor, may be assigned to a set or combination of categories of load size value 132 and air flow value 134. For example, a second value may be assigned to each combination of categories for load size value 132, air flow value 134, and cycle value 114. These second values may be determined through experimental iteration and programmed into the controller 82.

Second updated remaining cycle time 167 may, for example, be calculated by multiplying an elapsed time to reach the first dampness value 157, denoted by the reference numeral 169, by the various other values, such as heat value 116, dryness value 118, etc. and then subtracting the elapsed time 169 from the result. Further, this result may then be multiplied by a second correction factor. Finally, the total elapsed time of the cycle may be subtracted from this value to obtain a second updated remaining cycle time 167.

In some embodiments, method 100 may further include the step 170 of counting down from the second updated remaining cycle time 167 for a second subsequent countdown time 172. The second subsequent countdown time 172 may, for example, be a predetermined amount of time that may be programmed into the controller 82. In some embodiments, the second subsequent countdown time 172 may be based on the cycle value 114 or another suitable value, and a specific time 172 may be utilized depending on the cycle or other variable chosen. In other embodiments, the second subsequent countdown time 172 may be independent of such values and variables, and may simply be a programmed amount of time.

Method 100 may further include, for example, the step 175 of determining whether a second dampness value 177 has been reached. Such step 175 may occur, for example, during the step 170 of counting down from the second updated remaining cycle time 167 for the second subsequent countdown time 172. The second dampness value 177 may be based on, for example, the dampness sensed by the dampness sensor 92, which may for example be a voltage or other suitable variable. The second dampness value 177 may be determined through experimental iteration and programmed into the controller 82. Notably, the value 177 may be less than the first dampness value 157, and may further be associated with a specific category of dryness value 118, such as less damp or slightly damp.

In some cases, the threshold of the second dampness value 177 may not be reached during second subsequent countdown time 172. Method 100 may thus further include, for example, the step 180 of transmitting an extended time indicator 182. Such step 180 may occur, for example, when the second subsequent countdown time 172 expires and, at the time of this expiration, the second dampness value 177 has not been reached. The extended time indicator 182 may, for example, be transmitted to the display 84. In some embodiments, the display 84 may indicate a "racetrack" mode when the extended time indicator 182 is transmitted thereto.

In other cases, the threshold of the second dampness value 177 may be reached during second subsequent countdown time 172. In some embodiments, as illustrated in FIG. 3, method 100 may thus further include, for example, the step 185 of calculating a third updated remaining cycle time 187 based on the load size value 132 and the air flow value 134.

Such step 185 may occur when, for example, the second dampness value 177 has been reached.

For example, in some embodiments, a third value, or correction factor, may be assigned to a set or combination of categories of load size value 132 and air flow value 134. For example, a third value may be assigned to each combination of categories for load size value 132, air flow value 134, and cycle value 114. These third values may be determined through experimental iteration and programmed into the controller 82.

Third updated remaining cycle time 187 may, for example, be calculated by multiplying an elapsed time to reach the second dampness value 177, denoted by the reference numeral 189, by the various other values, such as heat value 116, dryness value 118, etc. and then subtracting the elapsed time 189 from the result. Further, this result may then be multiplied by a third correction factor. Finally, the total elapsed time of the cycle may be subtracted from this value to obtain a third updated remaining cycle time 187.

In some embodiments, method 100 may still further include the step 190 of counting down from the third updated remaining cycle time 187 for a third subsequent countdown time 192. The third subsequent countdown time 192 may, for example, be a predetermined amount of time that may be programmed into the controller 82. In some embodiments, the third subsequent countdown time 192 may be based on the cycle value 114 or another suitable value, and a specific time 192 may be utilized depending on the cycle or other variable chosen. In other embodiments, the third subsequent countdown time 192 may be independent of such values and variables, and may simply be a programmed amount of time.

Method 100 may further include, for example, the step 195 of determining whether a final dampness value 197 has been reached. Such step 195 may occur, for example, during the step 190 of counting down from the third updated remaining cycle time 187 for the third subsequent countdown time 192. The final dampness value 197 may be based on, for example, the dampness sensed by the dampness sensor 92, which may for example be a voltage or other suitable variable. The final dampness value 197 may be determined through experimental iteration and programmed into the controller 82. Notably, the value 197 may be less than the first dampness value 157 and the second dampness value 177, and may further be associated with a specific category of dryness value 118, such as normal dry, extra dry, or any other suitable dryness level that is dryer than the damp or slightly/less damp settings discussed herein. In exemplary embodiments, the final dampness value 197 is a value associated with the selected dryness value 118.

In some cases, the threshold of the final dampness value 197 may not be reached during third subsequent countdown time 192. Method 100 may thus further include, for example, the step 200 of transmitting an extended time indicator 202. Such step 200 may occur, for example, when the third subsequent countdown time 192 expires and, at the time of this expiration, the final dampness value 197 has not been reached. The extended time indicator 202 may, for example, be transmitted to the display 84. In some embodiments, the display 84 may indicate a "racetrack" mode when the extended time indicator 202 is transmitted thereto.

In other cases, the threshold of the final dampness value 197 may be reached during third subsequent countdown time 192. In some embodiments, as illustrated in FIG. 3, method 100 may thus further include, for example, the step 205 of calculating a final updated remaining cycle time 207 based on the load size value 132 and the air flow value 134. Such step 205 may occur when, for example, the final dampness value 197 has been reached. Calculation of the final updated remaining cycle time 207 is generally understood in the art. Examples of suitable methods for calculation of the final updated remaining cycle time 207 are provided in, for example, U.S. Pat. No. 7,013,578, filed on Apr. 23, 2004 and issued on Mar. 21, 2006, which is incorporated by reference herein in its entirety.

Once the final updated remaining cycle time 207 is calculated, a final countdown period and cool down period may be completed. For example, in some embodiments, method 100 may further include the step 210 of counting down from the final updated remaining cycle time 207 until the cool down value 119 is reached. Once the cool down value 119 is reached, a cool down cycle may be performed, as is generally understood in the art.

It should be noted that, in the above described embodiments, method 100 may include various steps that continue beyond the determination of a first dampness value 157, which in exemplary embodiments may be associated with a damp category, and a second dampness value 177, which in exemplary embodiments may be associated with a slightly damp or less damp category. However, in some embodiments, a user may have selected damp or slightly/less damp as a dryness value 118. In these embodiments, method 100 need not include various of these steps. Rather, a truncated method may be utilized, wherein for example the method proceeds from step 155 to step 205' as illustrated in FIG. 4 or from step 175 to a similar final updated remaining cycle time step (not illustrated). Step 205' may include, for example, calculating a final updated remaining cycle time 207 based on the load size value 132 and the air flow value 134. Such step 205' may occur when, for example, the first dampness value 157 has been reached. Calculation of the final updated remaining cycle time 207 is generally understood in the art. Examples of suitable methods for calculation of the final updated remaining cycle time 207 are provided in, for example, U.S. Pat. No. 7,013,578, filed on Apr. 23, 2004 and issued on Mar. 21, 2006, which is incorporated by reference herein in its entirety.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a dryer appliance, the method comprising:

calculating an initial cycle time;

initiating a dry cycle;

counting down from the initial cycle time for an initial countdown time between two minutes and five minutes immediately following the initiating of the dry cycle;

establishing, during the step of counting down from the initial cycle time for the initial countdown time, a load size value and an air flow value;

calculating a first updated remaining cycle time based on the load size value and the air flow value after establishing the load size value and the air flow value; and displaying the first updated remaining cycle time at a display mounted to a cabinet of the dryer appliance, wherein the load size value is selected from a plurality of predetermined categories comprising a large category, a medium category, or a small category, and wherein the air flow value is established from a plurality of predetermined categories comprising a high category, a medium category, or a low category.

2. The method of claim 1, wherein the initial cycle time is based on a cycle value, a heat value, and a dryness value.

3. The method of claim 1, wherein the first updated remaining cycle time is further based on a cycle value, a heat value, and a dryness value.

4. The method of claim 1, further comprising:

counting down from the first updated remaining cycle time for a first subsequent countdown time; and determining, during the step of counting down from the first updated remaining cycle time for the first subsequent countdown time, whether a first dampness value has been reached.

5. The method of claim 4, further comprising transmitting an extended time indicator when the first subsequent countdown time expires and the first dampness value has not been reached.

6. The method of claim 4, further comprising calculating, when the first dampness value has been reached, a second updated remaining cycle time based on the load size value and the air flow value.

7. The method of claim 6, further comprising:

counting down from the second updated remaining cycle time for a second subsequent countdown time; and determining, during the step of counting down from the second updated remaining cycle time for the second subsequent countdown time, whether a second dampness value has been reached.

8. The method of claim 7, further comprising transmitting an extended time indicator when the second subsequent countdown time expires and the second dampness value has not been reached.

9. The method of claim 7, further comprising calculating, when the second dampness value has been reached, a third updated remaining cycle time based on the load size value and the air flow value.

10. The method of claim 9, further comprising:

counting down from the third updated remaining cycle time for a third subsequent countdown time; and determining, during the step of counting down from the third updated remaining cycle time for the third subsequent countdown time, whether a final dampness value has been reached.

11. The method of claim 10, further comprising transmitting an extended time indicator when the third subsequent countdown time expires and the final dampness value has not been reached.

12. The method of claim 10, further comprising calculating, when the final dampness value has been reached, a final updated remaining cycle time based on the load size value and the air flow value.

13. The method of claim 12, further comprising counting down from the final updated remaining cycle time until a cool down value is reached.

14. The method of claim 4, further comprising calculating, when the first dampness value has been reached, a final updated remaining cycle time based on the load size value and the air flow value.

15. The method of claim 14, further comprising counting down from the final updated remaining cycle time until a cool down value is reached.

* * * * *